US005349797A

United States Patent [19]

Stultz

[11] Patent Number: 5,349,797

[45] Date of Patent: Sep. 27, 1994

[54] JOINT LIQUID STOP

[75] Inventor: Jeffrey H. Stultz, Freeport, Tex.

[73] Assignee: The Dow Chemical Company, Midland, Mich.

[21] Appl. No.: 55,156

[22] Filed: Apr. 29, 1993

[51] Int. Cl.[5] ..... E04B 1/68

[52] U.S. Cl. ..... 52/396.05; 52/396.02; 404/64

[58] Field of Search ..... 52/247, 396, 396.02, 52/396.05, 396.1, 396.03, 396.07; 404/53, 62, 64

[56] References Cited

U.S. PATENT DOCUMENTS

| | | | |
|---|---|---|---|
| 639,961 | 12/1899 | DeMan | 404/69 |
| 1,544,733 | 7/1925 | Ferrarini | 404/67 |
| 1,918,554 | 7/1933 | Older | 404/69 |
| 1,953,308 | 4/1934 | Older | 404/68 |
| 2,161,333 | 6/1939 | Capouch | 404/67 |
| 2,865,267 | 12/1958 | Bailey | 52/396 X |
| 3,172,237 | 3/1965 | Bradley | 52/396 X |
| 3,465,532 | 9/1969 | Belden | 52/396 X |
| 3,850,539 | 11/1974 | Bowman et al. | 404/69 |
| 3,884,000 | 5/1975 | Faleij | 52/396 X |
| 3,951,562 | 4/1976 | Fyfe | 404/68 |
| 4,098,047 | 7/1978 | Weber | 52/741 |
| 4,127,350 | 11/1978 | Weber | 52/396 X |
| 4,287,691 | 9/1981 | Guenther | 52/192 X |
| 4,615,161 | 10/1986 | Mileham | 52/396 |
| 4,740,404 | 4/1988 | Otsugu et al. | 52/396 X |
| 4,743,139 | 5/1988 | Spavin | 404/65 |

FOREIGN PATENT DOCUMENTS

| | | | |
|---|---|---|---|
| 495853 | 9/1953 | Canada | 52/396 |
| 1092630 | 11/1960 | Fed. Rep. of Germany | 52/396 |
| 943031 | 11/1963 | United Kingdom | 52/396 |
| 2205872 | 12/1988 | United Kingdom | 52/396 |

OTHER PUBLICATIONS

U.S. Official Gazette entry for U.S. Pat. No. 5,197,250: patentee–Kramer; 30 Mar. 1993.

*Primary Examiner*—Carl D. Friedman
*Assistant Examiner*—Kevin D. Wilkens

[57] ABSTRACT

A slab with two or more adjacent sub-slabs with a space therebetween and a liquid stop spanning the space, a portion of the liquid stop embedded in each of the sub-slabs. In one aspect, when joint material is present in the space, the liquid stop is, preferably, disposed beneath the joint material. A liquid containment system for a treatment facility with liquid containing vessel(s) and slab(s) which includes liquid stop apparatus for each slab/slab interface and liquid stop apparatus for each slab/vessel interface.

6 Claims, 5 Drawing Sheets

JOINT LIQUID STOP

BACKGROUND OF THE INVENTION

1. Field Of The Invention

This invention is related to slabs and in one aspect to leak prevention in concrete joints.

2. Description of Related Art

Typically large concrete slabs are comprised of sub-parts or smaller slabs with some type of joint between the smaller slabs. These joints may be spaces between the smaller slabs or spaces with material therein such as a board or asphaltic joint material. Water or spilled liquids can easily flow in the spaces and to the joint filler material, and then beneath the slabs. Caulking or putty used to fill in joint spaces, expansion joints, or stop devices, have not solved the liquid flow problems.

There has long been a need for prevention of liquid flow through concrete joints and beneath concrete slabs. There has long been a need for a liquid stop under concrete slabs. There has long been a need for a secondary containment system for liquids spilled on concrete slabs.

SUMMARY OF THE PRESENT INVENTION

The present invention, in one embodiment, discloses a concrete slab comprising two or more sub-slabs with a space therebetween. Extending across the space and partially into each sub-slab is a liquid stop member which extends along the length of the space between the sub-slabs thereby forming a secondary containment system and preventing liquid, e.g. rain or spilled liquid, from passing through the space and seeping under the slab.

In one aspect a liquid stop member is anchored at an edge of a slab which abuts another structure such as a tank foundation ring support. Lapping stop material anchored to the structure and interconnected with the slab liquid stop material prevents liquid from flowing down between a slab-structure interface. In the case where the slab is not expected to settle, the liquid stop material can be embedded both in the slab and in the vessel foundation, extending across the slab-vessel interface and preventing liquid from flowing down between the slab and vessel.

In another aspect, the liquid stop according to this invention also prevents liquid beneath a slab from flowing upwardly in a slab joint onto part of the slab.

In one method according to this invention a plural component slab with a secondary spill containment system is, preferably, made with a single concrete pour. Forms are put in place for sub-slabs of the slab with appropriate reinforcing members, such as steel rebar. Liquid stops are emplaced, preferably beneath the reinforcing members since cracks often form at and propagate from such members and it is desirable to locate a liquid stop so that it will be beneath any cracks that form. Preferably the liquid stops are made from material that is believed to be resistant to liquids which may potentially be spilled on the slab. Concrete is then poured in the forms and allowed to cure.

In one aspect the present invention provides a secondary leak containment system for one or more liquid containing vessels located on or adjacent one or more slabs, e.g. the vessels and slabs of a liquid sludge treatment facility. In an embodiment in which there are multiple vessels and multiple slabs, each slab-slab interface has a liquid stop system as described herein and each slab-vessel interface has a liquid stop system as described herein.

It is, therefore, an object of at least certain preferred embodiments of the present invention to provide:

- New, useful, unique, efficient, non-obvious devices for; preventing liquid from flowing between a slab edge and another abutting structure such as another slab or a vessel or building;
- Such devices and methods which include a secondary containment system for liquid spilled on a slab;
- Such devices and methods which reduce or eliminate slab cracking;
- Such systems which may be formed with a single concrete pour;
- Such devices which are useful with both settling structures and non-settling structures; and
- Such devices which prevent liquid flow in either of two directions: downwardly from above between a slab joint and beneath the slab; and from beneath the slab up between the joint and onto the slab.

This invention resides not in any particular individual feature, but in the combinations of them herein disclosed and claimed and it is distinguished from the prior art in these combinations with their structures and functions.

There has thus been outlined, rather broadly, features of the invention in order that the detailed descriptions thereof that follow may be better understood, and in order that the present contributions to the arts may be better appreciated. There are, of course, additional features of the invention that will be described hereinafter and which may form the subject matter of the claims appended hereto. Those skilled in the art will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar that do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1:
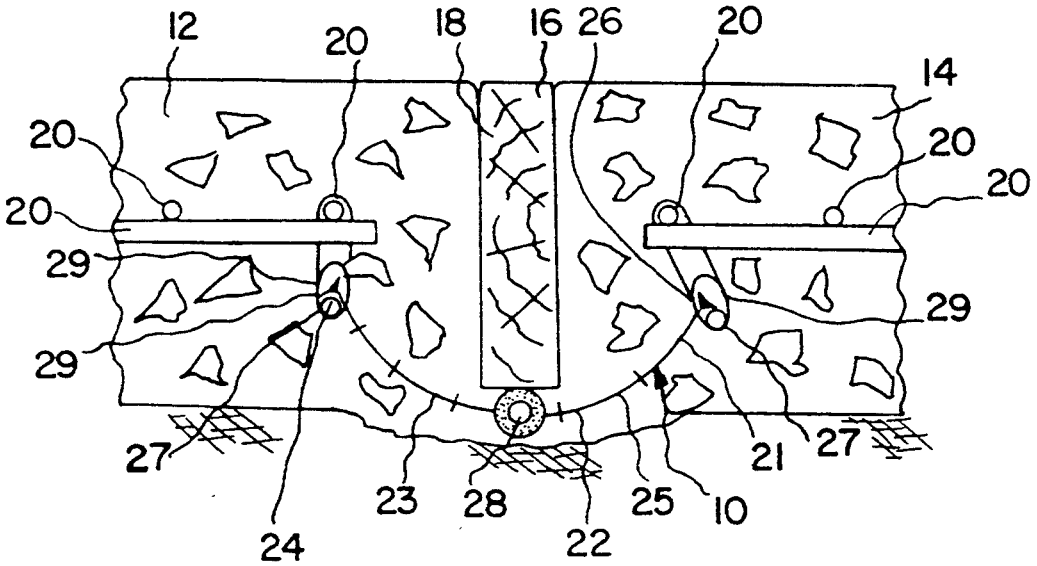
FIG. 1 is a side cross-sectional view of a slab according to the present invention

Referring now to FIG. 1, a slab 10 according to the present invention has two sub-slabs 12 and 14. Joint material 16, e,g. a treated wooden board or asphaltic board, is in an expansion/control joint space 18 between the sub-slabs 12 and 14. Steel rebar 20 reinforces the sub-slabs. A liquid stop 22 made preferably of polyvinylchloride has two edges 24 and 26 and two portions 23 and 25, each portion embedded in one of the sub-slabs. A part 28 of the liquid stop 22, preferably a tubular portion, is disposed directly beneath the joint material 16 and in certain preferred embodiments the liquid stop 22 has a plurality of ribs 21 along its length. Although it is within the scope of this invention for the liquid stop 22 to be flat or inverted, it is preferred that it be disposed as shown (a V-shape or U-shape when viewed from the end) and that the edges 24 and 26 be attached to pieces of rebar 20, both to inhibit cracking and to inhibit sagging of the liquid stop 22 due to the weight of concrete thereon. It is preferred that the liquid stop 22 be beneath the steel rebar 20 and that rebar 27 be used to anchor the liquid stop 22; the liquid stop 22 tied with a tie wire 29 to the rebar 27.

Figure 2A:
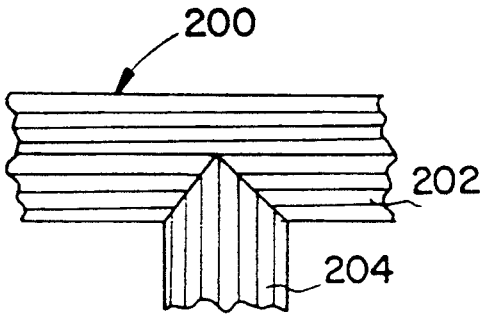
FIGS. 2A, 2B and 2C present partial top views of liquid stops according to this invention.
Figure 2B:
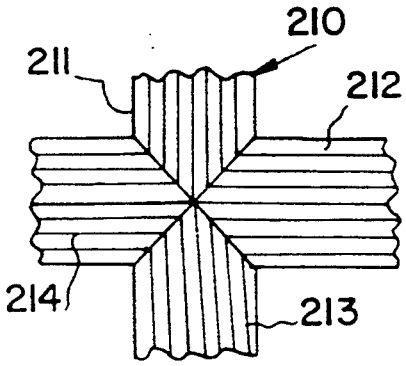
Figure 2C:
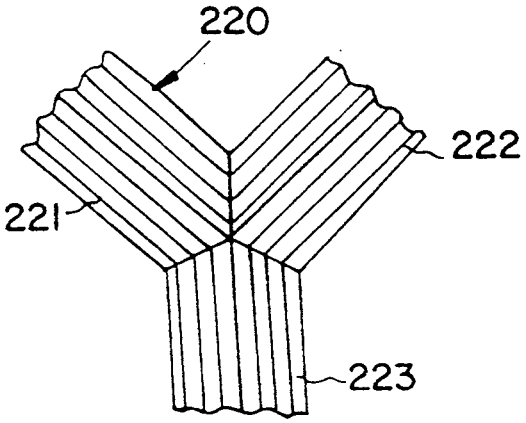

FIGS. 2A, 2B and 2C show various configurations of a liquid stop according to this invention for accommodating various types of interfaces of slabs. The liquid stop 200 in FIG. 2A has a cross portion 202 and seal welded to it an intersecting portion 204. This liquid stop 200 is useful where two slabs (on either side of the portion 204) are adjacent a slab above the portion 202. In the liquid stop 210 of FIG. 2B four sections 211, 212, 213, 214 intersect and are seal welded together. This liquid stop 210 is useful where corners of four slabs are adjacent each other. The liquid stop 220 is FIG. 2C has three portions 221, 222, 223 seal welded together. This liquid stop 220 is used where three slab corners are adjacent each other.

Figure 3A:
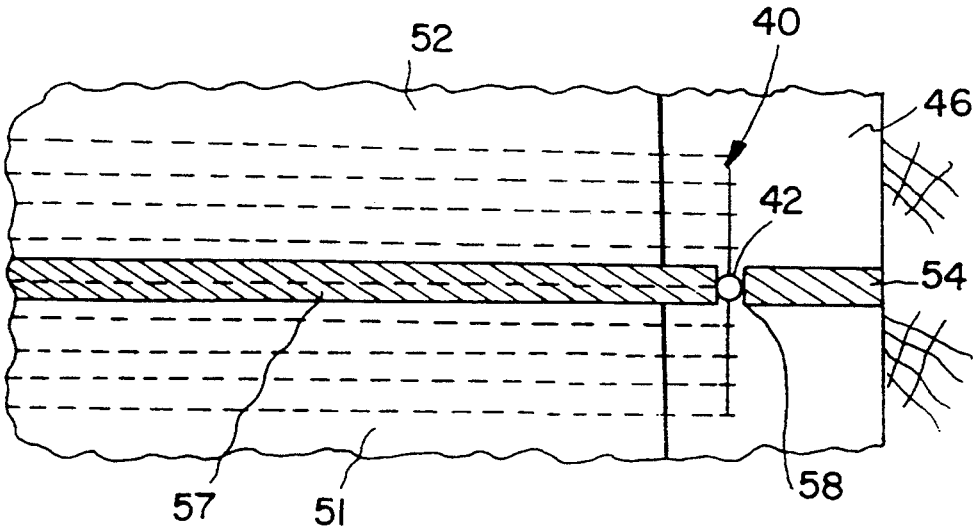
FIG. 3A is a top partial view of a system according to the present invention.
Figure 3B:
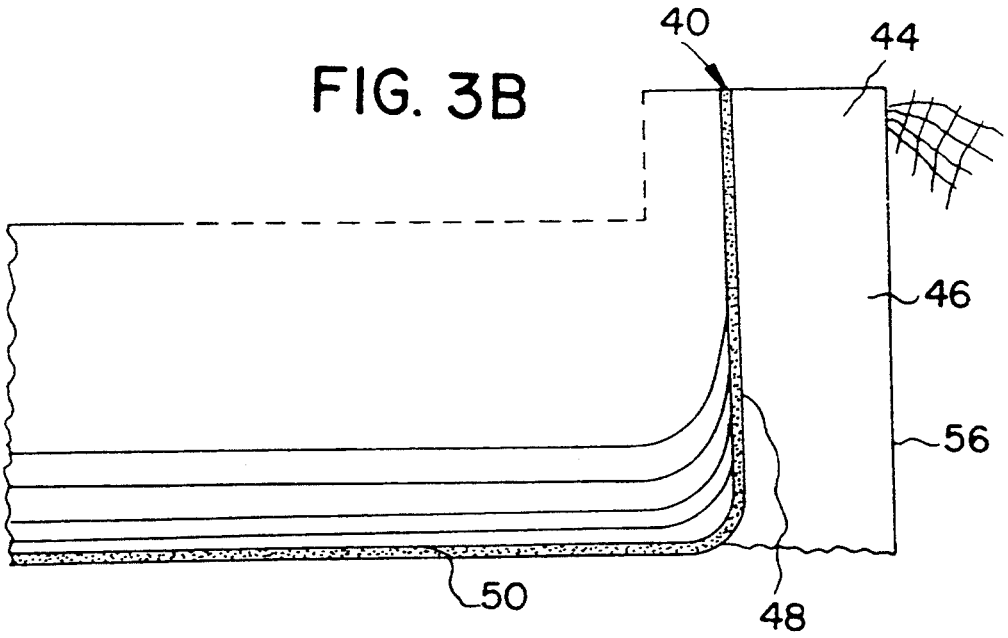
FIG. 3B is a side cross-sectional view of the system of FIG. 3A.

FIGS. 3A and 3B illustrate a system 40 according to the present invention which includes the termination of a sealed joint 42 at a top portion 44 of a curb 46. A liquid stop 48 extends along a bottom 50 of between two opposed slabs 51 and 52 and then upwardly in the curb 46. A control joint 54 expansion joint material extends from an outer edge 56 of the curb 46 inwardly to meet a tubular portion 58 of the liquid stop 48 to which it is sealed. In embodiments in which a curb is present at an opposite end of the slabs (to the left in FIG. 3A) the liquid stop is similarly disposed and sealed and extends along the entire length of the slabs beneath an expansion joint member 59.

Figure 4A:
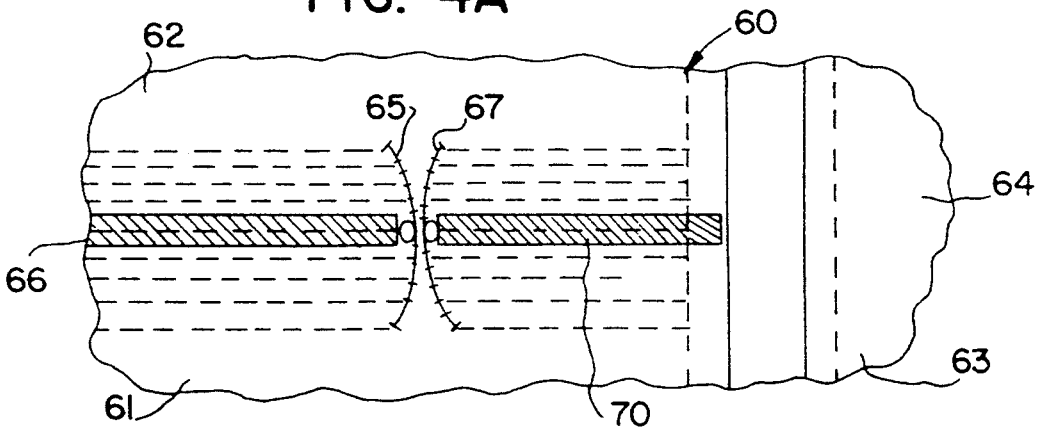
FIG. 4A is a top partial view of a system according to the invention.
Figure 4B:
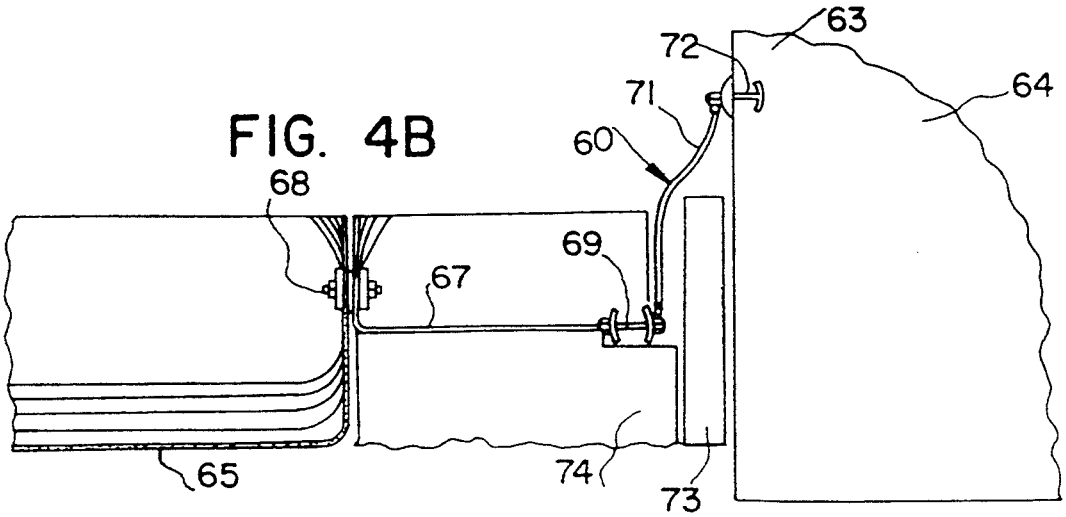
FIG. 4B is a side cross-sectional view of the system of FIG. 4A.

As shown in FIGS. 4A and 4B a system 60 according to the present invention provides a sealed structure for the interface of slabs 61 and 62 and a wall 63 of a containment vessel 64. This particular embodiment is useful when the vessel 64 and/or one of the slabs 61 or 62 expand, contract, or settle in place. To accommodate relative movement of these things while preventing liquid from flowing in a slab/slab or slab/vessel interface, the system 60 has a liquid stop 65 which extends along and adjacent bottoms of the slabs 61 and 62 and beneath an expansion member 66. The liquid stop 65 is bolted to another liquid stop 67 with bolt assembly 68 and the liquid stop 67 extends from the bolt assembly 68 to an anchor 69 embedded partially in each slab (and extending preferably, around an entire outer circumference of the vessel 64) to which the liquid stop 67 is secured by seal welding. The liquid stop 67 extends beneath an expansion member 70. A lapping member 71 is seal welded to the anchor 69 and to another anchor 72 embedded in the vessel wall 63 above the top of the slabs 61 and 62. Thus a seal member extends from a point on the vessel wall above the slabs and across the slab/vessel interface (and preferably completely along any slab/slab interface). An expansion member 73 is emplaced between the vessel wall 63 and ends 74 of the slabs. Liquid stops and anchors made of appropriate materials may be seal welded together by heat fusion.

In certain preferred embodiments it is preferred that the following items be made from the material listed:

| | |
|---|---|
| liquid stop 65 | ribbed polyvinylchloride, 6 inches wide, .75 inches thick, with .75 diameter center bulb |
| bolt assembly 68 | stainless steel |
| liquid stop 67 | low density polyethylene sheet 60 mils thick |
| anchors 69, 72 | high density polyethylene (HDPE) |
| lapping material 71 | HDPE, 60 mils thick |
| expansion member 73 | styrofoam, 1 inch thick |

Figure 4C:
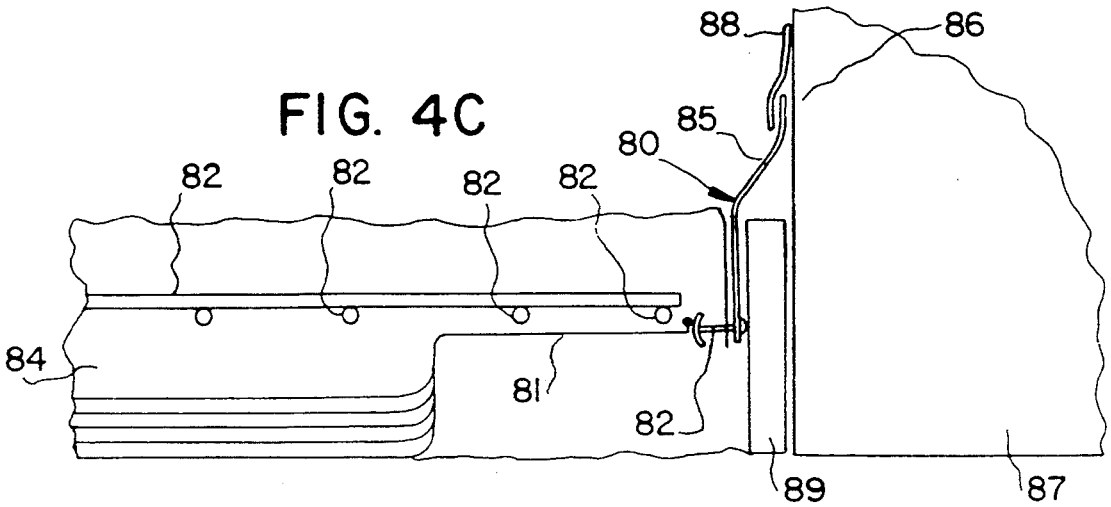
FIG. 4C is a side cross-sectional view of an alternative system (according to this invention) to that of 4A.

The embodiment of a system 80 according to the present invention shown in FIG. 4C is similar to that of FIG. 4A, but a liquid stop 81 is seal welded directly to an anchor 82. The liquid stop 81 is preferably disposed beneath steel reinforcing members 82 in adjacent slabs (one slab, 84, shown in FIG. 4C). Another liquid stop 85 (preferably of HDPE) is seal welded to the anchor 82 and extends upwardly along a wall 86 of a vessel 87. A shield 88 (preferably of fiber reinforced plastic) bonded to the wall 86 (e.g. by bonding material such as a catalyzed resin bonder) extends downwardly overlapping the liquid stop 85. An expansion member 89 (like the expansion member 73, FIG. 4B) is disposed between the vessel and the slabs.

Figure 5A:
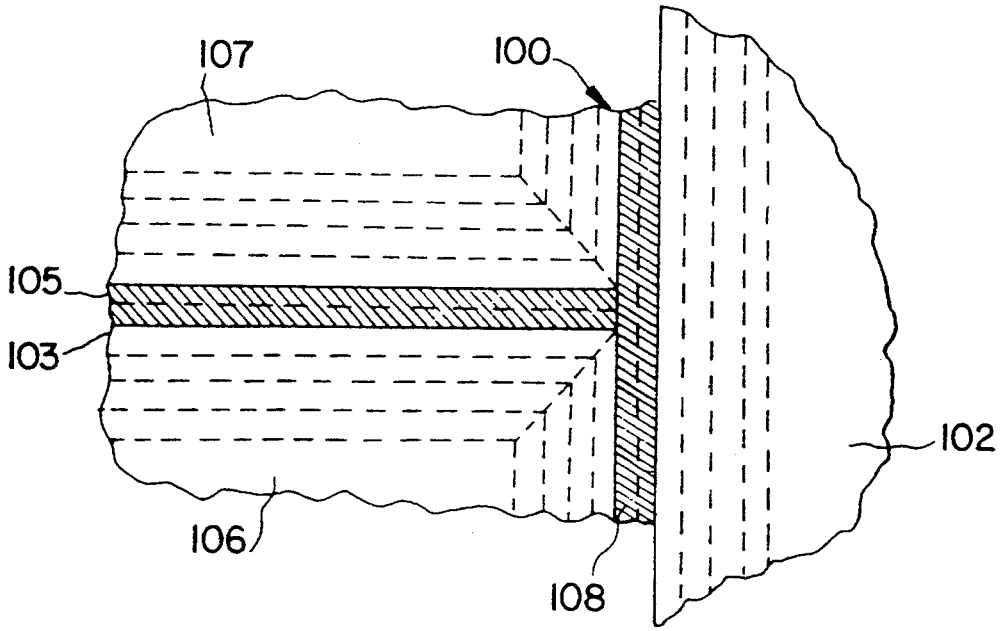
FIG. 5A is a top view of a system according to this invention.
Figure 5B:
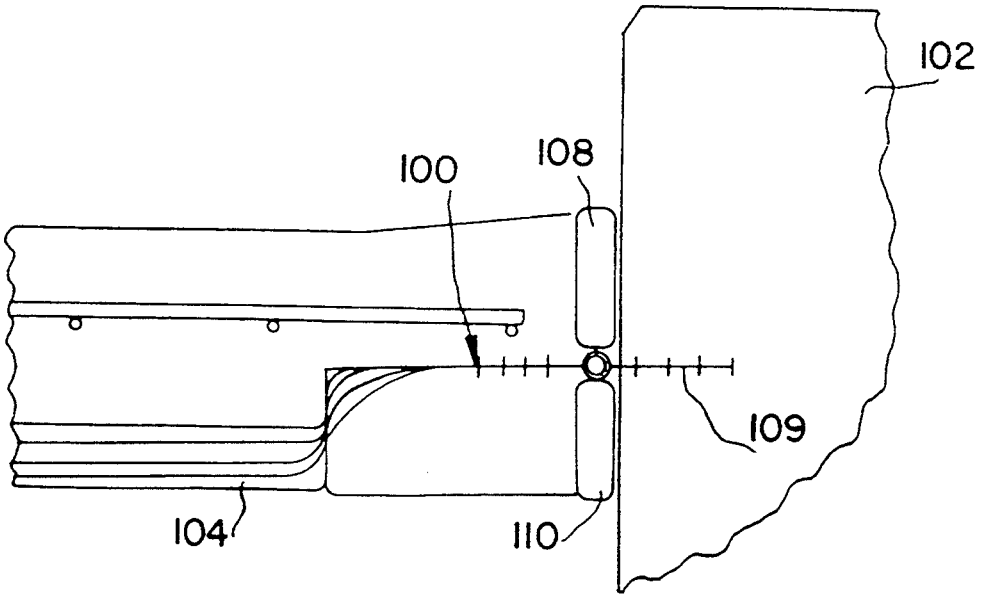
FIG. 5B is a side cross-sectional view of the system of FIG. 5A.

FIGS. 5A and 5B show a system 100 according to this invention for a situation in which a vessel (or building) 102 is not expected to settle in place. A slab 103 adjacent the vessel 102 has a liquid stop 104 extending beneath an expansion joint 105 between sub-slabs 106 and 107. The liquid stop 104 is sealingly secured to a liquid stop 109 which is partially embedded in the sub-slabs 106 and 107; and partially embedded in the vessel 102. Expansion joint members 108 and 110 encompass the vessel 102 and are disposed above and below the liquid stop 109 and between the slab 103 and the vessel 102.

Figure 6:
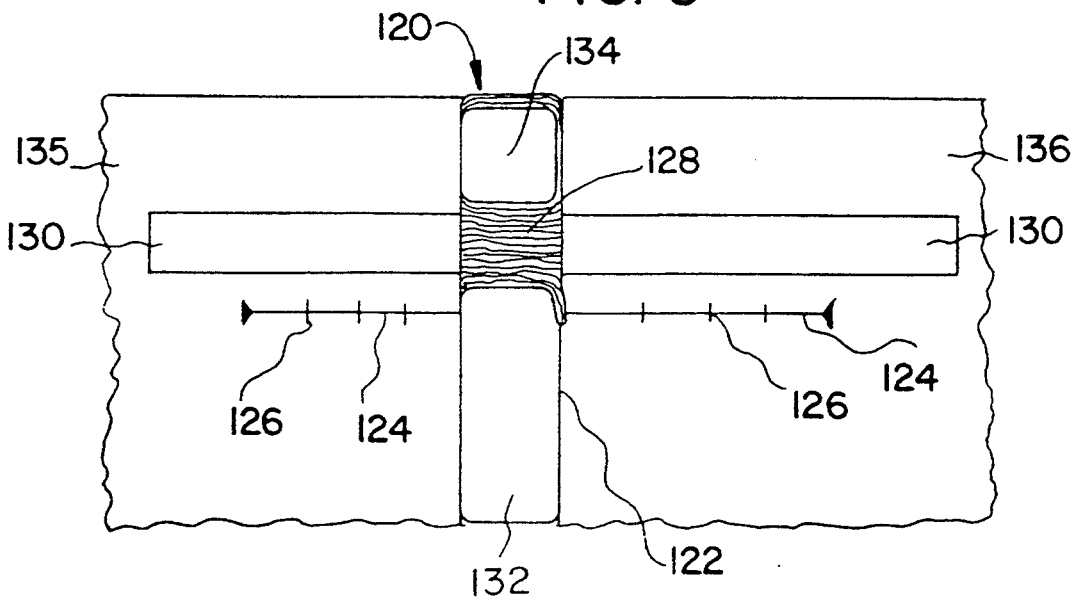
FIG. 6 is an end view in cross-section of a system according to this invention.

FIG. 6 illustrates an expansion joint member 120 for use between slabs 135, 136; the member 120 having a central body 122 from which project opposed arms 124 with a plurality of ribs 126 extending therefrom. Preferably the expansion joint member also includes one or more corrosion resistant load transfer bars 130 which project from the central body 122. The central body may be solid, but preferably is hollow; and most preferably has an interior member 128 configured and disposed to correspond in location to the load transfer bars 130. The expansion member 120 as shown has two interior hollow spaces 132 and 134. The expansion member 120 may be made of any suitable material; including, but not limited to high density polyethylene, low density polyethylene, or ultraviolet-stabilized polyvinylchloride and may include load transfer bars made of any suitable material; including, but not limited to, steel, stainless steel, fiberglass, or fiberglass coated steel. The preferable form is a strip which can extend along the length of a space between two adjacent spaced-apart slabs.

Figure 7:
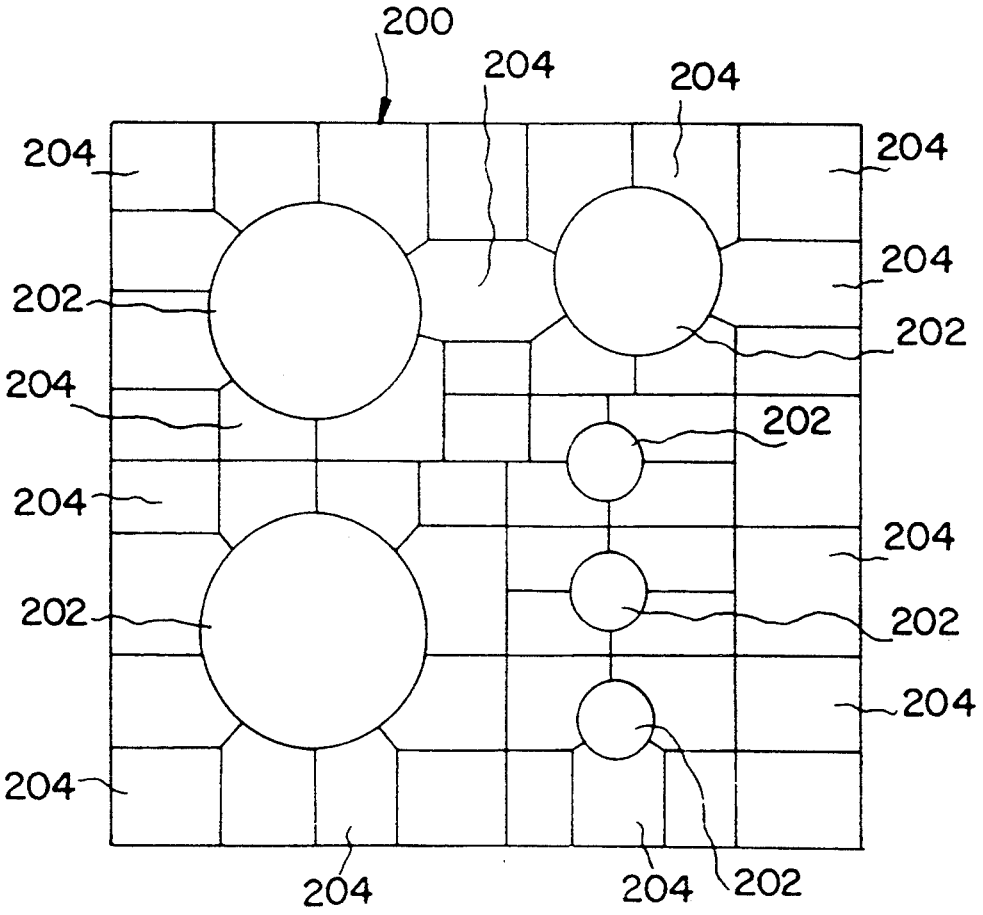
FIG. 7 is a top schematic view of a system according to the present invention.

FIG. 7 illustrates schematically a system 200 according to this invention. Each circular item 202 in the system 200 is a material containing vessel. Each non-circular item 204 (including all non-circular items in FIG. 7) is a concrete slab. Every slab/slab interface and every slab/vessel interface in the system 200 is effected by using one of the previously described embodiments of the present invention so that the entire surface of the system 200 is sealed to prevent spilled liquid from flowing under the system 200 and to prevent the pumping up of any material from beneath the system 200. When material is pumped up from beneath, either between slabs or between a slab and vessel, a void remains beneath the system 200 which can result in cracks to the slab and damage to the vessels.

Filed on even date herewith are the following applications, co-owned with this application, whose subject matter is hereby disclosed herein and which may be employed with the present invention in a material treatment system (invention titles followed by applicant(s) name):

Sludge Digestion; J. Stultz, D. Bice
Sludge Ammonia Removal; J. Stultz, D. Bice
Sludge Deodorization; J. Stultz, D. Bice
Tank Foundation; J. Stultz
Pipe To Concrete Transition; J. Stultz
Sludge Clarifier Bottom; J. Stultz, H. Rabren
Sludge Clarifier Roof; J. Stultz
Hopper Liner; J. Stultz
Waste Gas Incineration; J. Stultz, D. Bice In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A liquid containment system for a treatment facility, the treatment facility including a plurality of spaced-apart liquid containing vessels and a plurality of concrete slabs one adjacent the other with spaces therebetween, vessels adjacent slabs at an interface thereof, the system comprising slab liquid stop member means between each of every two adjacent slab members; the liquid stop member means comprising a first slab stop portion, a second slab stop portion, and a third slab stop portion; the first slab stop portion embedded in one of two adjacent slabs, the second slab stop portion embedded in the other of the two adjacent slabs, and the third slab stop portion extending along a length of a space between the slabs, an expansion joint member disposed between the slabs above the third slab stop portion, vessel liquid stop member means between each vessel and every slab adjacent a vessel; the vessel liquid stop member means comprising a first vessel stop portion having a first end secured to an exterior wall of the vessel, and a second end secured to an anchor embedded in a slab adjacent the vessel to seal the interface between the vessel and the slab.

2. A liquid containment system for a treatment facility, the treatment facility including a plurality of spaced-apart liquid containing vessels and a plurality of concrete slabs one adjacent the other with spaces therebetween, vessels adjacent slabs at an interface thereof, the system comprising slab liquid stop member means between each of every two adjacent slab members; the liquid stop member means comprising a first slab stop portion, a second slab stop portion, and a third slab stop portion; the first slab stop portion embedded in one of two adjacent slabs, the second slab stop portion embedded in the other of the two adjacent slabs, and the third slab stop portion extending along a length of a space between the slabs, an expansion joint member disposed between the slabs above the third slab stop portion, vessel liquid stop member means between each vessel and every slab adjacent a vessel; the vessel liquid stop member means comprising a first vessel stop portion having a first top end secured to an exterior wall of the vessel and a second bottom end beneath the first top end spaced apart from the exterior wall of the vessel, and the slab liquid stop member means including a fourth slab stop portion having a first end secured to the anchor embedded in the slab and a second end overlapped by the second end of the first vessel stop portion.

3. A liquid containment system for a slab interface between a first slab and a second slab, the first slab spaced apart from the second slab by a space, and for a curb interface between an edge of both slabs and a curb adjacent the edges of both slabs, the system comprising a liquid stop means for preventing liquid flow through the space between the slabs, the liquid stop means comprising a strip which extends along and beneath the slabs and the space between the slabs, and the liquid stop means further comprising an upwardly extending portion of the strip extending into the curb adjacent the edges of both slabs.

4. The system of claim 3 comprising also a slab expansion member in the space between the slabs.

5. The system of claim 4 wherein there is a portion of the curb adjacent each slab and a curb space between the curb portions, and a curb expansion member disposed in the curb space.

6. The system of claim 5 wherein the liquid stop means has a central tubular portion which on one side abuts the slab expansion member and on the other side abuts the curb expansion member.

* * * * *